US007854428B2

(12) United States Patent
Allen, Jr. et al.

(10) Patent No.: US 7,854,428 B2
(45) Date of Patent: Dec. 21, 2010

(54) ROTARY DIE CUT STACKING SYSTEM HAVING OPTICAL BEAM GENERATOR TO FACILITATE THE POSITIONING OF LAYBOY ARMS

(75) Inventors: Clarence Allen, Jr., Crawford, VA (US); Michael Lippy, Herndon, VA (US); John Lavin, Ridgewood, NJ (US)

(73) Assignee: A. G. Stacker Inc., Weyers Cave, VA (US)

( * ) Notice: Subject to any disclaimer, the term of this patent is extended or adjusted under 35 U.S.C. 154(b) by 306 days.

(21) Appl. No.: 12/100,947

(22) Filed: Apr. 10, 2008

(65) Prior Publication Data

US 2008/0251995 A1 Oct. 16, 2008

Related U.S. Application Data

(60) Provisional application No. 60/911,226, filed on Apr. 11, 2007.

(51) Int. Cl.
*B65H 5/02* (2006.01)

(52) U.S. Cl. ..... 271/272; 271/198

(58) Field of Classification Search ..... 271/272, 271/198, 200, 184, 225; 83/72, 73, 75, 76.7, 83/86, 94, 345

See application file for complete search history.

(56) References Cited

U.S. PATENT DOCUMENTS

| | | | | |
|---|---|---|---|---|
| 3,321,202 | A | 5/1967 | Martin | |
| 3,419,266 | A | 12/1968 | Martin | |
| 3,860,232 | A * | 1/1975 | Martin | 271/198 |
| 5,768,137 | A * | 6/1998 | Polidoro et al. | 700/186 |
| 6,427,097 | B1 | 7/2002 | Martin et al. | |

* cited by examiner

*Primary Examiner*—Stefanos Karmis
*Assistant Examiner*—Michael C McCullough
(74) *Attorney, Agent, or Firm*—Muncy, Geissler, Olds & Lowe, PLLC

(57) ABSTRACT

A rotary die cut stacking system for use with a rotary die cutter having a rotary die configured to output die-cut sheets of material, the system including a stacker and a layboy for carrying die-cut sheets of material in a first direction from the die cutter to the stacker, wherein, the layboy has upper arms and lower arms defining a nip region therebetween for receiving the die-cut sheets, at least some of the upper arms and at least some of the lower arms being moveable transversely to the first direction, the layboy including at least one optical beam generator configured to direct an optical beam against a portion of the rotary die cutter so that a position of the arms relative to the rotary die can be determined based on the location of the optical beam on the portion of the rotary die cutter.

18 Claims, 6 Drawing Sheets

ROTARY DIE CUT STACKING SYSTEM HAVING OPTICAL BEAM GENERATOR TO FACILITATE THE POSITIONING OF LAYBOY ARMS

CROSS-REFERENCE TO RELATED APPLICATIONS

The present application claims the benefit of U.S. Provisional Patent Application 60/911,226, filed Apr. 11, 2007, the entire contents of which is hereby incorporated by reference.

BACKGROUND OF THE INVENTION

1. Field of Invention

The present invention is directed towards a rotary die cut stacking system having an optical beam generator to assist with the positioning of layboy arms relative to a die cutter and to a method of mounting an optical beam generator in a rotary die cut stacking system, and, more specifically, towards a rotary die cut stacking system having a plurality of lasers mounted on layboy arms for assisting with the positioning of the layboy arms relative to a rotary die and to a method of mounting lasers on the layboy arms of a rotary die cut stacking system.

2. Description of Related Art

Devices for stacking sheets of material received from a rotary die cutter are well known. One example of such a device is the AGS2000 Rotary Die Cut Stacker made by the assignee of the present invention, A.G. Stacker, Inc., Weyers Cave, Va. Further examples of such devices are disclosed in U.S. Pat. Nos. 3,321,202 to Martin and 3,419,266 to Martin, each of which is expressly incorporated by reference in its entirety.

FIGS. 1 and 2 illustrate a conventional rotary die cut stacking system. As illustrated therein, the system 100 typically comprises a layboy section 102 which receives blanks or sheets of material, such as those produced by a rotary die cutting machine having a top die 126 and a bottom drum 128, and discharges the blanks onto a transfer conveyor 104. The transfer conveyor 104 receives the blanks and transports them to a main conveyor 106. The main conveyor 106 has an intake end 108 and a discharge end 110. At its intake end 108, the main conveyor 106 is mounted to a base 112 at a pivot point 114 so that the conveyor may be pivoted to raise the discharge end 110 of the conveyor 106. At the discharge end 110 of the conveyor 106, the blanks pass through an accumulator section 116 and form a stack at a stacking location 121.

The layboy section 102 has a first plurality of upper arms 130 and a second plurality of lower arms 132 which may be, but are not necessarily, equal in number. Typically, six to eight upper arms and six to eight lower arms are provided. Each of the upper and lower arms 130 and 132 is a moveable assembly rotatably supporting a driven belt 134. The belts 134 on the upper and lower arms 130 and 132 form a nip region 136 where sheets or blanks from the rotary die cutter are drawn into the layboy section 102.

Conventional die cutting machines may output one, two, three of four rows of blanks simultaneously. As these rows of sheets enter the nip region 136 in rows of one, two, three or four and move along the layboy section 102, the upper and lower arms 130, 132 steer the blanks and change the orientation and/or row spacing of the blanks in a predetermined manner so that the blanks are deposited onto the transfer conveyor 104 in a desired manner. When the layboy arms are used to space multiple rows of blanks, they will often not be parallel to each other, and they will not all be perpendicular to the surface of the die 126.

In conventional systems, an operator sets the positions of the layboy arms while standing on one side of the layboy section. Generally, a long rod is used to pull or push the individual arms back and forth in the width direction of the stacking machine to put the arms into appropriate positions. The layboy arms should be positioned so that they are not located between adjacent blanks and so that they contact parts of the blanks that can be readily driven. For example, on blanks having a plurality of openings or having flaps, it may be desirable for the bands of the layboy arms to contact the blanks at positions away from the flaps or openings. However, layboy 102 may be 80 to 200 inches wide, and the arms may each be angled differently with respect to the surface of the rotary die 126. The distance from the edge of the layboy 102 to a given arm 130, 132 and the angle that a particular arm makes relative to the die 126 make it difficult to determine whether the layboy arms 130, 132 are positioned appropriately. Therefore, several adjustments may be necessary when a new run of blanks is started to determine the proper position of each of the six to eight layboy arms. Shutting down a production line while such adjustments are made reduces efficiency and can be costly. Because the relative positions of the arms and the die may not be readily determined, it may be necessary to stop the die cutter and reposition the layboy arms several times before a satisfactory placement is obtained. Accordingly, it would be desirable to provide an apparatus and method for helping a machine operator to place the arms of a layboy in a desired position relative to a die cutter in an efficient manner.

SUMMARY OF THE INVENTION

These and other problems are addressed by the present invention, a first aspect of which comprises a rotary die cut stacking system for use with a rotary die cutter having a rotary die configured to output die-cut sheets of material, the rotary die cut stacking system including a stacker with a conveyor for transporting die-cut sheets to a stacking location and a layboy for carrying the die-cut sheets of material in a first direction from the rotary die cutter to the stacker. The layboy comprises a first plurality of upper arms and a second plurality of lower arms defining a nip region therebetween for receiving the die-cut sheets, and at least some of the first plurality of upper arms and at least some of the second plurality of lower arms are moveable transversely to the first direction. The layboy also includes at least one optical beam generator associated with at least one of the first plurality of upper arms or second plurality of lower arms that is configured to direct an optical beam against a portion of the rotary die cutter. In this manner, a position of the at least one of the first plurality of upper arms or second plurality of lower arms relative to the rotary die can be determined based on the location of the optical beam on the rotary die cutter.

Another aspect of the invention is a method performed with a rotary die cutting system that includes a rotary die cutter having a rotary die for outputting sheets of material in a first direction, a stacker for stacking sheets of material output from the rotary die cutter, and a layboy having a plurality of upper and lower arms for receiving sheets of material output from the rotary die cutter and transporting the sheets to the stacker. The plurality of upper and lower arms are slidable in a second direction transverse to the first direction. The method provides an indication of a position of at least one of the plurality of upper and lower arms relative to the rotary die cutter and includes steps of associating a first optical beam generator with at least one of the plurality of upper and lower arms, aligning the first optical beam generator with the first arm, and directing an optical beam produced by the first optical beam generator against the rotary die cutter.

A further aspect of the invention comprises a rotary die cut stacking system for use with a rotary die cutter having a rotary die configured to output die-cut sheets of material. The stacking system comprises a stacker with a conveyor for transporting the output die-cut sheets to a stacking location and a layboy carrying the die-cut sheets of material in a first direction from the rotary die cutter to the stacker. The layboy comprises a plurality of upper arms and lower arms defining a nip region therebetween for receiving the die-cut sheets, and at least some of the plurality of upper arms are moveable transversely to the first direction. The layboy further includes a first plurality of lasers mounted on the first plurality of upper arms that are configured to direct a first plurality of laser beams against the rotary die. In this manner, a position of each of the first plurality of upper arms relative to the rotary die can be determined based on the location of the first plurality of laser beams on the rotary die.

BRIEF DESCRIPTION OF THE DRAWINGS

These and other aspects of certain embodiments of the present invention will be more apparent from the following description taken in conjunction with the accompanying drawings, in which.

DETAILED DESCRIPTION

Figure 1:
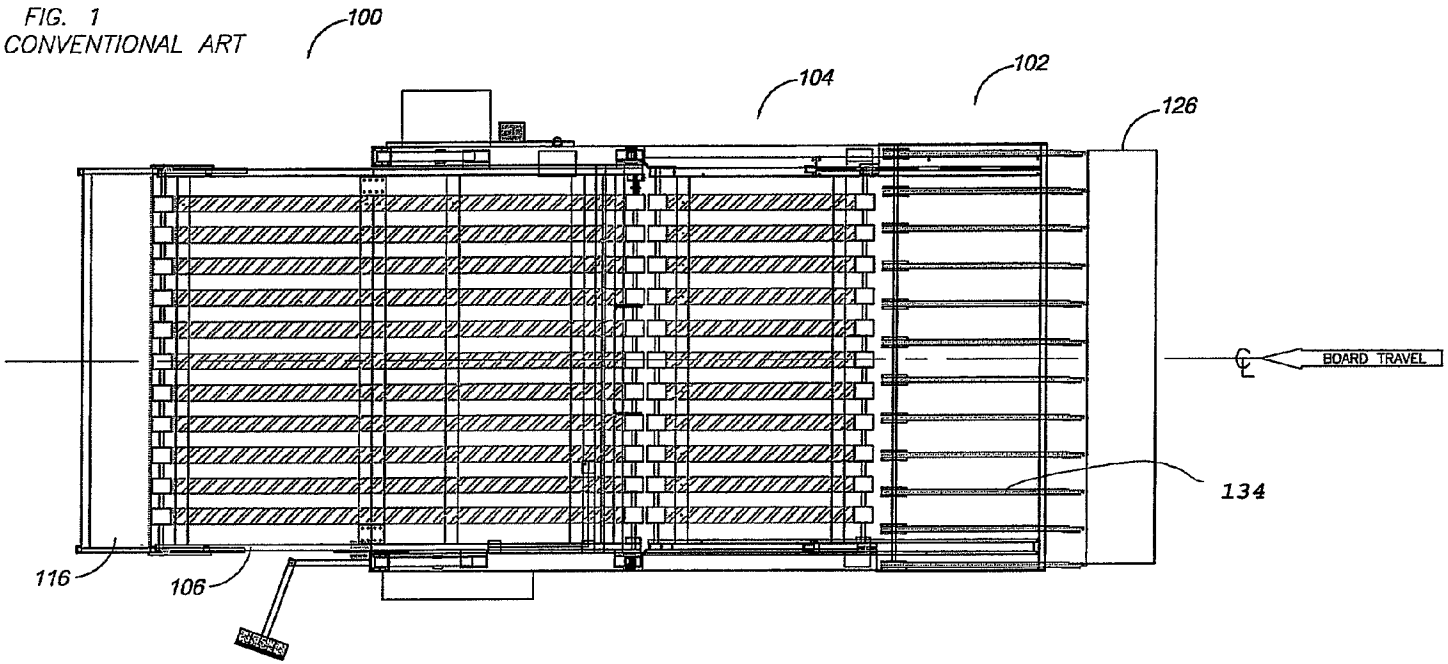
FIG. 1 CONVENTIONAL ART
FIG. 1 is a top plan view of a conventional rotary die cut stacking system including a die cutter, a layboy section and a stacker.
Figure 2:
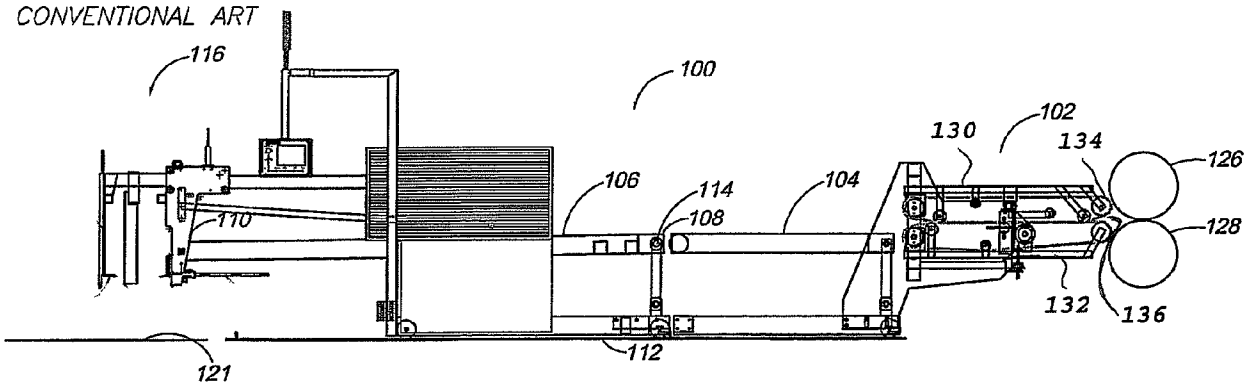
FIG. 2 CONVENTIONAL ART
FIG. 2 is a side elevational view of the rotary die cut stacking system of FIG. 1.
Figure 3:
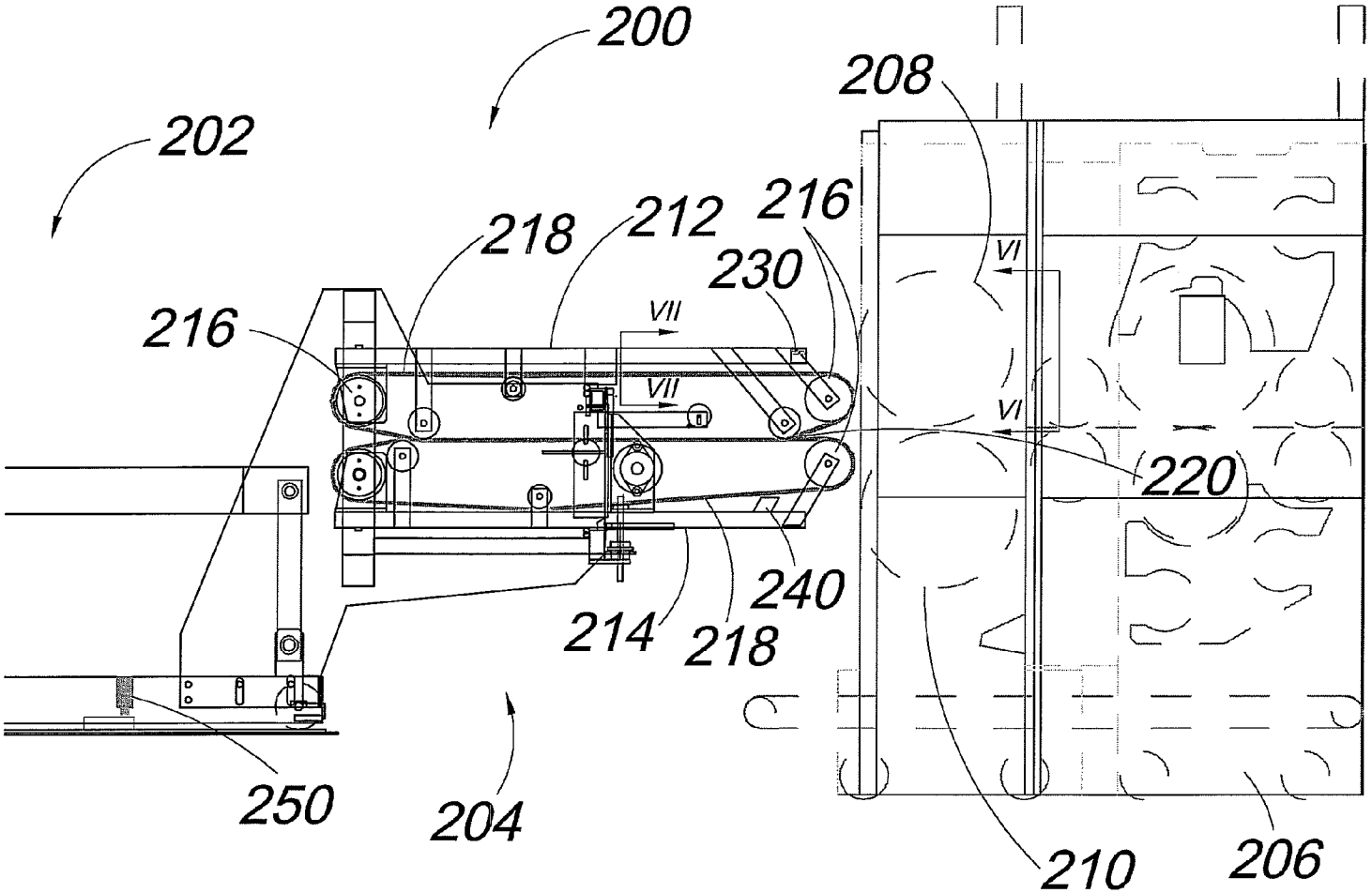
FIG. 3 is side elevational view of the layboy section of the rotary die cut stacking system of an embodiment of the present invention in which one upper and one lower arm of the layboy section are visible.

Referring now to the drawings, wherein the showings are for purposes of illustrating preferred embodiments of the invention only, and not for the purpose of limiting same, FIG. 3 illustrates a rotary die cutting system 200 that includes a stacker 202, a layboy section 204, and a rotary die cutter 206 having a rotary die 208 and an opposite drum 210. Layboy section 204 comprises a first plurality of upper arms 212, only one of which is illustrated in FIG. 3, and a second plurality of lower arms 214, only one of which is illustrated in FIG. 3. The number of upper arms 212 may differ from the number of lower arms 214, but it is often the same.

Each of the upper arms 212 and lower arms 214 includes a plurality of grooved wheels 216 for supporting a continuous band of material 218. The bands 218 on the upper arms 212 and the bands 218 on the lower arms 216 approach each other in a nip region 220 into which sheets of material move when they enter the layboy section 204. The bands 218 on the upper arms 212 are driven in a first direction by a drive (not illustrated), clockwise in FIG. 3, and the bands on the lower arms 214 are driven in a second direction, opposite to the first direction and counterclockwise in FIG. 3, so that sheets entering nip region 220 are pulled into and along layboy section 204 toward stacker 202. The upper arms 212 and lower arms 214 can be individually positioned laterally with respect to rotary die 208 and angled with respect to the surface of the rotary die 208 and with respect to each other for reasons known to those of ordinary skill in the art.

Figure 4:
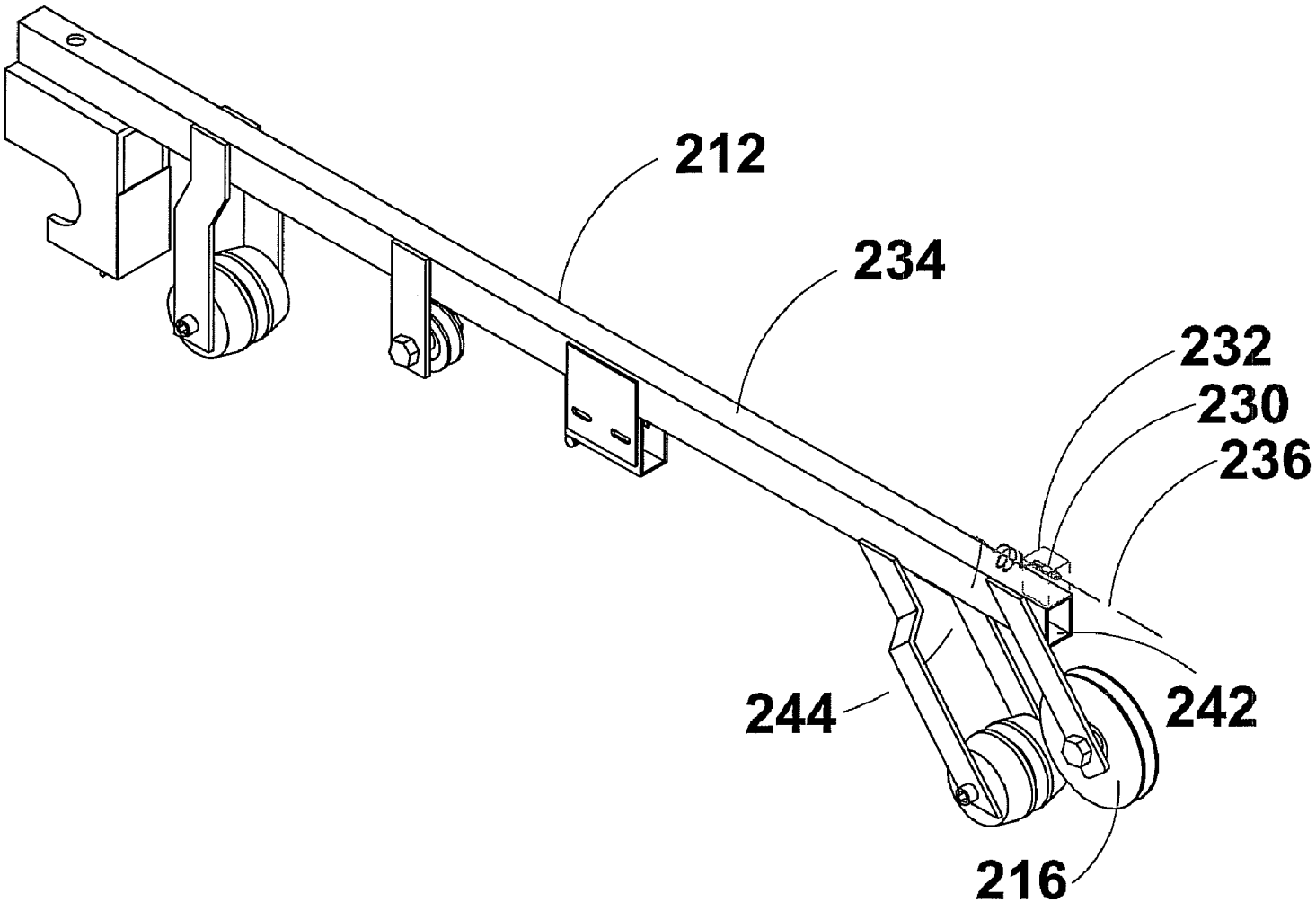
FIG. 4 is an isometric view of an upper arm of the layboy section of FIG. 3 with an optical beam generating device mounted thereon.
Figure 5:
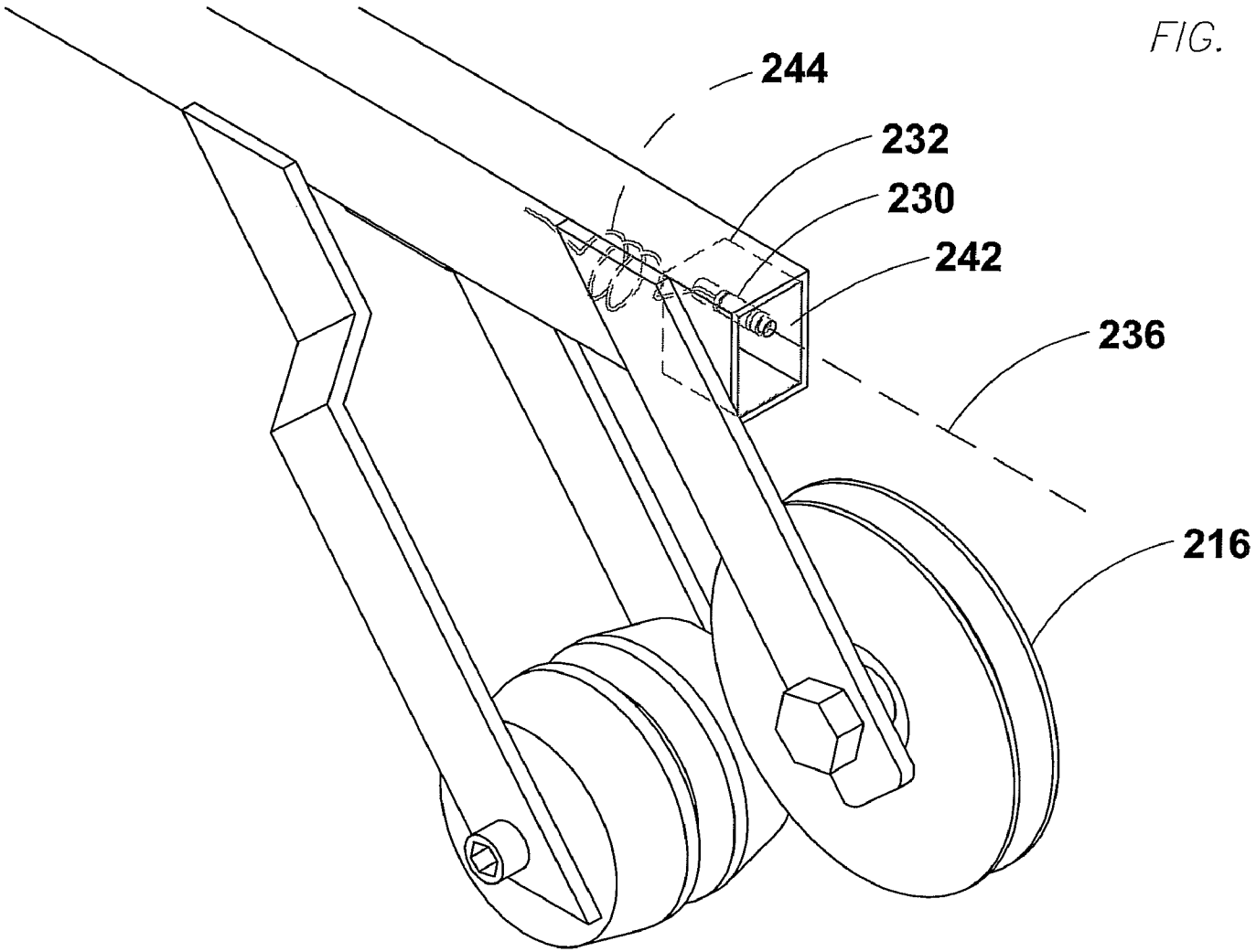
FIG. 5 is an isometric view of an upper arm of the layboy section of FIG. 3, with an optical beam generator mounted therein.
Figure 6:
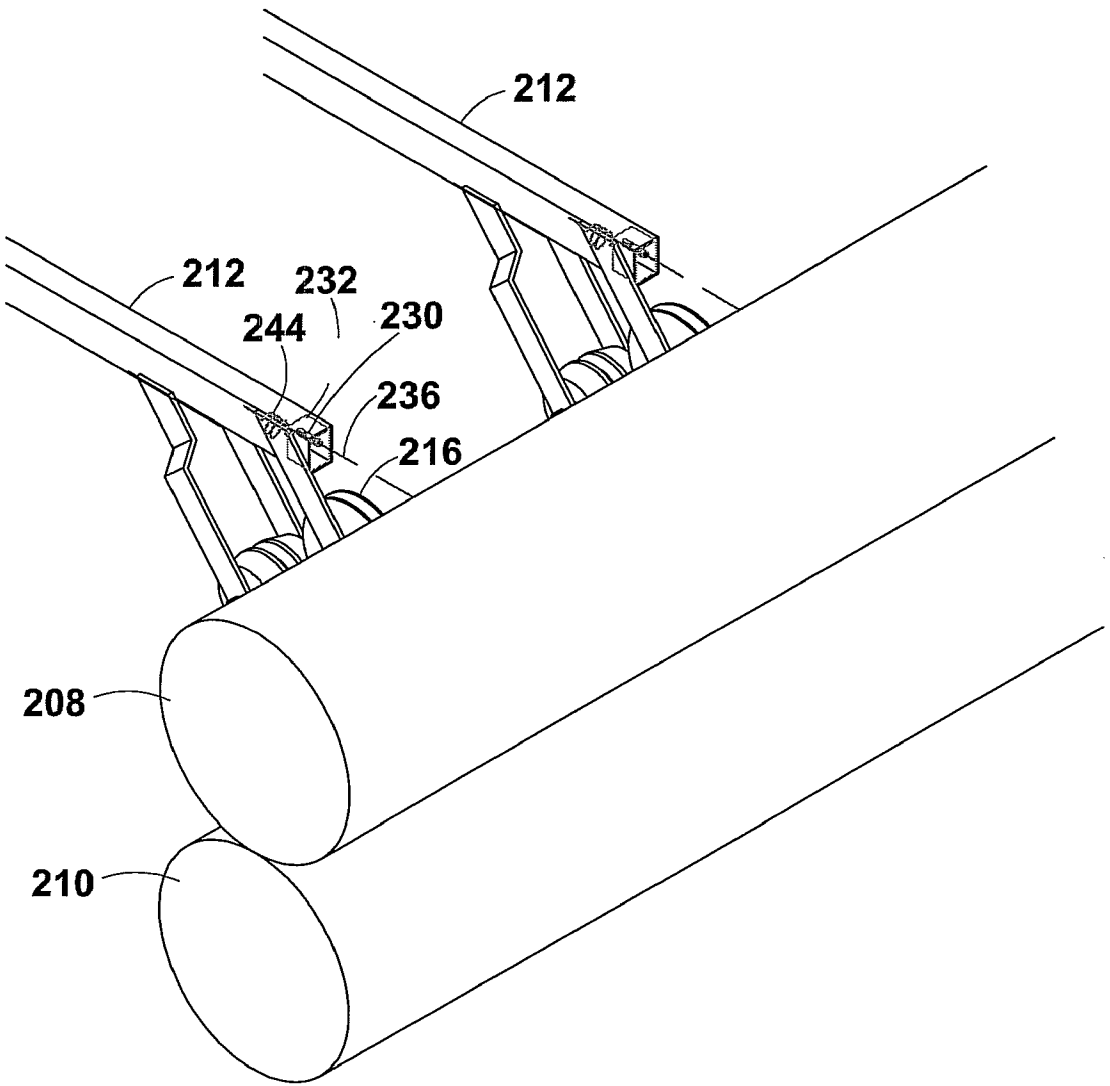
FIG. 6 is a partial isometric view of the layboy section of FIG. 3 taken in the direction of line VI-VI in FIG. 3.
Figure 7:
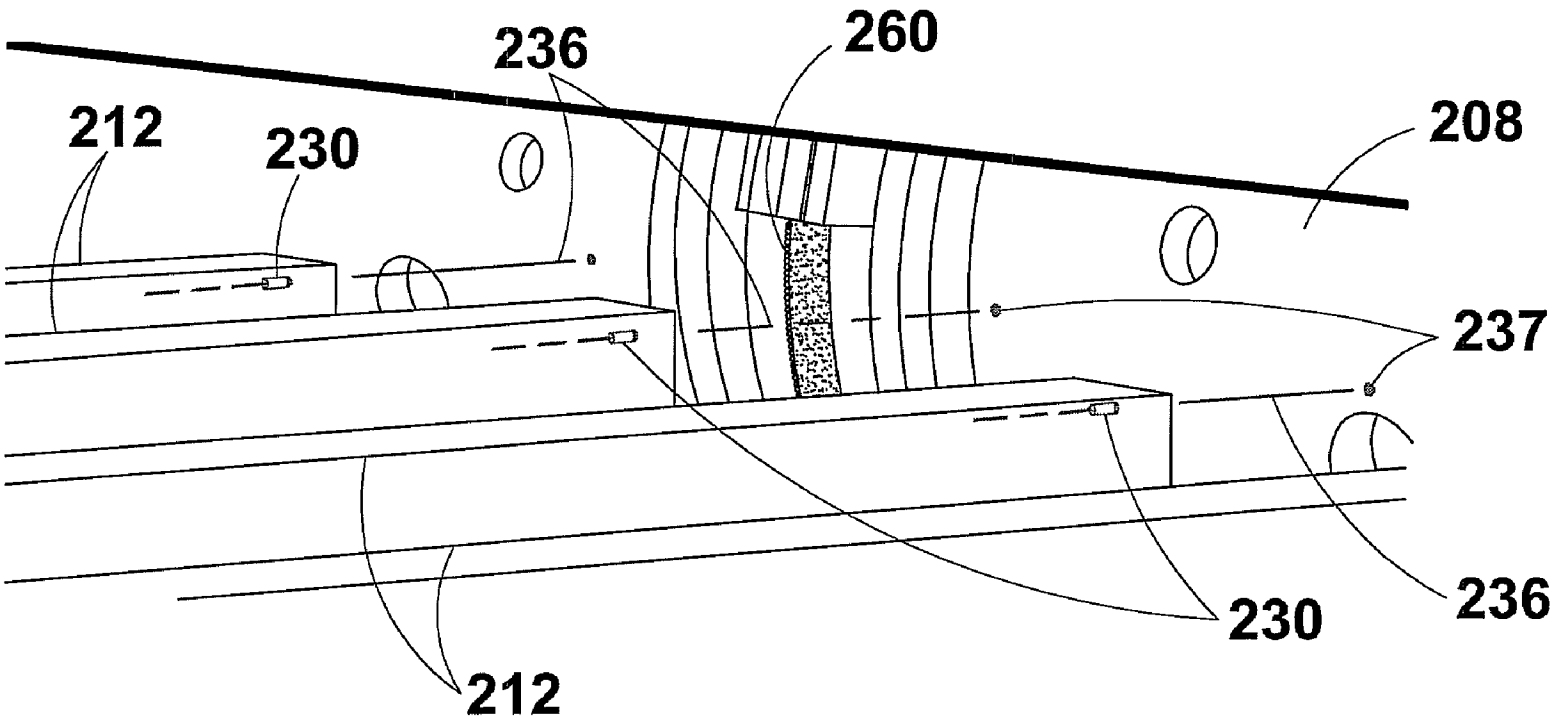
FIG. 7 is a partial isometric view of the layboy section of FIG. 3 taken in the direction of line VII-VII in FIG. 3.

At least one, and in the preferred embodiment, each, of the upper arms 212 is provided with an optical beam generator for forming a dot or other image on a surface of rotary die cutter 206. A presently preferred optical beam generator comprises a laser such as laser 230; however, other light sources capable of forming a discernable image on the die cutter 206 could alternately be used. Laser 230 may be mounted in a housing 232 on an upper surface 234 of upper arm 212, as illustrated in FIG. 4, so that the beam 236 generated by the laser impinges on the surface of rotary die 208 as a dot 237 or other desired shape. An alternative placement of laser 230 is illustrated in FIG. 5 which shows housing 232 mounted in the interior 242 of upper arm 212. This provides additional protection for laser 230 while still allowing beam 236 to exit from the end of the upper arm 212 and impinge on the surface of the die 208. Suitable wiring 244 may be connected to a switch or a controller (not illustrated) for controlling the lasers. The wiring 244 may, using either laser placement, be routed through the interiors 242 of the upper arms 212. Low power lasers, such as the type used in conventional laser pointers, are known that can operate on battery power. In some systems, it may be desirable to use such battery powered lasers on the upper arms 212 to avoid the need for wiring. Such lasers could be controlled individually or by a suitable remote control (not illustrated).

Optionally, additional lasers 240 can be mounted on lower arms 214 with their beams directed against the rotary die 208 to assist with the alignment of the lower arms 214. However, it has generally been found adequate to provide only lasers 230 on the upper arms 212; once the upper arms are aligned as discussed hereinafter, the lower arms can be positioned relative to the upper arms with sufficient precision for most purposes. If lasers 240 are provided on the lower arms, it may be desirable to use lasers that produce a color of light different than the light emitted by the lasers 230 mounted on the upper arms to distinguish lasers 230 of the upper arms 212 from the lasers 240 of the lower arms 212. Alternately, the lasers 230 of the upper arms could be aimed along a first portion of the die 208 while the lasers of the lower arms 214 could be aimed along a second portion of the die 208. Only lasers 230 of upper arms 212 are discussed further herein; the placement and use of optional lasers 240 on lower arms 214 will be clear from the description of the lasers 230.

In some embodiments, lasers 230 may be illuminated continuously, while in others, the lasers 230 may be controlled by a switch or a controller to turn on only when upper arms 212 are being positioned. Optionally, as illustrated in FIG. 3, a limit switch 250 can be provided near a track on which transfer conveyor 204 is mounted. When transfer conveyor 204 moves away from die cutter 206, which sometimes occurs during the setup of the system 200, the limit switch 250 is opened so that lasers 230 cannot be operated. This reduces the risk of having the lasers 230 accidently shine directly into the eyes of a person in the gap.

Whether the lasers 230 are mounted on upper surface 234 of upper arm 212 or in the interior 242 of upper arm 212, the lasers 230 are aligned with the longitudinal centerline of each of the upper arms 212 and with the centerlines of grooved wheels 216 and the bands 218 supported thereon. When the upper arms 212 are perpendicular to the surface of die 208, the location of the laser beam 236 on the surface of the die 208 provides an indication as to which portion of a blank exiting the die cutter 206 will contact bands 218. For example, if a given laser beam 236 impinges on an area between die blades 260, for cutting the outer edges of adjacent blanks, the operator will know that the band 218 on the upper arm 212 supporting that laser will not contact any blank reaching the layboy section 204. Therefore, that particular layboy upper arm 212 will have to be moved. Similarly, if a given laser beam 236 impinges on a portion of the die 208 that form flaps in a die-cut sheet, the band 218 on that upper arm 212 will contact the flap of a die-cut sheet reaching that layboy arm. This is also often not desirable, and the upper arm 212 can be repositioned to impinge against a portion of the die-cutter representing the portion of the blank that should contact the band 218.

When the upper arms 212 are angled slightly with respect to the surface of die 208 there will be a difference between the location on the die illuminated by the laser beam 236 and the corresponding portion of the die-cut sheet reaching the layboy section 204. However, those skilled in the art already appreciate the need to align arms angled with respect to the surface of die 208 in a different manner than arms perpendicular to the surface of die 208, and laser beam 236 impinging on the surface of die 208 provides a nearly instantaneous way of appreciating the relationship between each of the arms 212 and the die 208. It is also possible to align the laser beam 236 with a portion of rotary die cutter 206 other than die 208, such as a portion of a housing, for example. However, when it is possible to align the laser beam 236 with the surface of the die 208, it is a relatively simple matter for the machine operator to understand the relationship between the upper arms 212 and the die 208.

In operation, layboy section 204 is moved away from die cutter 206 to create a gap large enough for an operator to enter, and a suitable die 208 is installed on die cutter 206. Lasers 230 should be deactivated at this time to protect the eyes of the operator standing between the layboy 204 and the die cutter 206; safety sensor 250 provides additional protection against accidental activation. At this time the relative angles between the upper arms 212 of the layboy section 202 are set in a manner known in the art and based in part on the number of blanks (two, three or four, for example) that will be output from the die 208. The die cutter 206 is then moved back to a position close to the layboy 202, and lasers 230 are actuated in a suitable manner to form points of light 237 on the surface of die 208. An operator uses a long rod, possibly having an angled hook on one end (not illustrated) to slide each of the upper layboy arms 212 to a predetermined position relative to the upper die based in part on the location of the point of laser light on the die 208. The lower arms 214 of the layboy are then positioned relative to the upper arms in a conventional manner, slightly offset from each of the upper arms, for example, to reduce the pinching of die-cut blanks traversing the layboy section 202. The lasers may then be extinguished, and the operation of the die-cutting system commenced. Using lasers 230, the set up of a new die can be done quickly and accurately with less need for slow test runs to determine where a die-cut sheet will contact one of the bands 218 and less need for the multiple adjustments of the layboy arms that were often required with conventional systems.

Two possible mounting locations for lasers 230 have been described. However, the mounting of the lasers 230 is not particularly limited as long as a relationship between the laser 230 and the layboy arm 212 on which it is mounted is known. The present system, therefore can be provided as original equipment with new die cut stacking systems and also retrofitted onto existing systems without affecting the operation of those legacy systems. Because the lasers 230 do not need to be controlled by a system controller, retrofits may sometimes use separate on-off switches for the lasers 230 that are mounted in a convenient location for operators.

The present invention has been described herein in terms of several presently preferred embodiments. However, various modifications and additions to these embodiments will become apparent to those skilled in the relevant arts upon a reading of the foregoing disclosure. It is intended that all such modifications and additions comprise a part of the present invention to the extent they fall within the scope of the several claims appended hereto.

We claim:

1. A rotary die cut stacking system for use with a rotary die cutter having a rotary die configured to output die-cut sheets of material, the rotary die cut stacking system comprising:

a stacker including a conveyor for transporting die-cut sheets to a stacking location; and a layboy for carrying the die-cut sheets of material in a first direction from the rotary die cutter to the stacker, wherein, the layboy comprises a first plurality of upper arms and a second plurality of lower arms defining a nip region therebetween for receiving the die-cut sheets, at least some of the first plurality of upper arms and at least some of the second plurality of lower arms being moveable transversely to said first direction, the layboy including at least one optical beam generator associated with at least one of the first plurality of upper arms or second plurality of lower arms and configured to direct an optical beam against a portion of the rotary die cutter, whereby a position of the at least one of the first plurality of upper arms or second plurality of lower arms relative to the rotary die is determinable based on the location of the optical beam on the portion of the rotary die cutter.

2. The rotary die cut stacking system of claim 1 wherein said at least one optical beam generator comprises a laser.

3. The rotary die cut stacking system of claim 2 wherein said laser is mounted on said at least one of said first plurality of upper arms.

4. The rotary die cut stacking system of claim 3 wherein said at least one of said first plurality of upper arms comprises a hollow interior and wherein said laser is mounted in said hollow interior.

5. The rotary die cut stacking system of claim 2 further including a track supporting said stacker for rolling movement between a first location and a second location and including a switch for deactivating said laser when said stacker moves away from said first location.

6. The rotary die cut stacking system of claim 1 wherein said first plurality of upper arms is positionable independently of said second plurality of lower arms.

7. The rotary die cut stacking system of claim 1 wherein said first plurality of upper arms and said second plurality of lower arms support rotating belts for moving the die-cut sheets of material toward the stacker.

8. The rotary die cut stacking system of claim 1 wherein said at least one optical beam generator is mounted on one of said first plurality of upper arms.

9. The rotary die cut stacking system of claim 1 wherein said at least one optical beam generator comprises a plurality of optical beam generators.

10. The rotary die cut stacking system of claim 1 wherein said at least one optical beam generator comprises a plurality of lasers, one of said plurality of lasers being mounted on each of said first plurality of upper arms.

11. In a system comprising a rotary die cutter having a rotary die for outputting sheets of material in a first direction, a stacker for stacking sheets of material output from the rotary die cutter, and a layboy having a plurality of upper and lower arms for receiving sheets of material output from the rotary die cutter and transporting the sheets to the stacker, the plurality of upper and lower arms being slidable in a second direction transverse to said first direction, a method of providing an indication of a position of at least one of the plurality of upper and lower arms relative to the rotary die cutter comprising:

associating a first optical beam generator with at least one of the plurality of upper and lower arms;

aligning the first optical beam generator with the at least one of the plurality of upper and lower arms; and directing an optical beam produced by the first optical beam generator against the rotary die cutter.

12. The method of claim 11 wherein said step of directing an optical beam produced by the optical beam generator against the rotary die cutter comprises a step of directing the optical beam produced by the optical beam generator against a first location on the rotary die.

13. The method of claim 11 wherein said step of associating a first optical beam generator with the at least one of the plurality of upper and lower arms comprises the step of mounting a laser on the at least one of the plurality of upper and lower arms.

14. The method of claim 11 wherein said plurality of upper and lower arms includes second and third arms and including the additional steps of mounting second and third optical beam generators on the second and third arms, directing an optical beam generated by the second optical beam generator against a second location on the rotary die cutter and directing an optical beam generated by the third optical beam generator against a third location on the rotary die cutter.

15. The method of claim 11 including the additional steps of moving the at least one of the plurality of upper and lower arms relative to the rotary die cutter to move the optical beam generated by the first optical beam generator along the rotary die cutter and aligning the at least one of the plurality of upper and lower arms with a predetermined portion of the rotary die based on the location of the optical beam generated by the first optical beam generator on the rotary die cutter.

16. A rotary die cut stacking system for use with a rotary die cutter having a rotary die configured to output die-cut sheets of material, the stacking system comprising:

a stacker including a conveyor for transporting the output die-cut sheets to a stacking location; and a layboy carrying the die-cut sheets of material in a first direction from the rotary die cutter to the stacker, wherein the layboy comprises a plurality of upper arms and a plurality of lower arms defining a nip region therebetween for receiving the die-cut sheets, at least some of the plurality of upper arms being moveable transversely to said first direction, the layboy further including a plurality of lasers mounted on the plurality of upper arms and configured to direct a plurality of laser beams against the rotary die, whereby a position of each of the plurality of upper arms relative to the rotary die is determinable based on the location of the plurality of laser beams on the rotary die.

17. The rotary die cutting system of claim 16 wherein the plurality of upper arms and the plurality of lower arms each include a hollow interior and wherein one of said plurality of lasers is mounted in each said hollow interior.

18. The rotary die cutting system of claim 16 further including a track supporting said stacker for rolling movement between a first location and a second location and including a switch for deactivating said first plurality of lasers when said stacker moves away from said first location.

* * * * *